United States Patent [19]

Burley

[11] Patent Number: 4,995,508

[45] Date of Patent: Feb. 26, 1991

[54] DISPLAY CASE FOR SPORTSCARDS

[76] Inventor: David A. Burley, 2505 Wisconsin Ave., N. Muskegon, Mich. 49445

[21] Appl. No.: 462,488

[22] Filed: Jan. 10, 1990

[51] Int. Cl.[5] ..... G09F 1/10; B65D 1/34

[52] U.S. Cl. ..... 206/44 B; 206/45.34; 206/455; 40/124.2

[58] Field of Search ..... 206/44 B, 45, 45.34, 206/455, 456; 40/124.2

[56] References Cited

U.S. PATENT DOCUMENTS 2,103,241 12/1937 Bell ..... 206/45
4,102,072 7/1978 Buschman ..... 40/124.2

FOREIGN PATENT DOCUMENTS 517523 2/1940 United Kingdom ..... 206/45
787373 12/1957 United Kingdom ..... 206/456

*Primary Examiner*—William I. Price

[57] ABSTRACT

The lid portion of a norelco single cassette holder box or similar single cassette holder box lids are fastened together in such a fashion that when placed upside down in a display case of the correct dimensions, form rows of cavities with each cassette box lid having one cavity the correct width and dimensions of a hard plastic sportscard holder that is common to the trade and with these hard plastic holders having been placed into each cassette box lid or cavity and with the plexi-glas or similar material transparent cover of the display case in a closed position with the plexi-glas resting slightly against each of the hard plastic holders and with all parts joined together, forming one unit, a complete unit for transporting and/or display of sportscards.

5 Claims, 5 Drawing Sheets

DISPLAY CASE FOR SPORTSCARDS

BACKGROUND OF THE INVENTION

Field of Invention

The present invention relates to display cases, and more particularly, to cases with both display and storage capabilities for sportscards or other cards with similar dimensions.

SUMMARY OF THE INVENTION

The object and primary feature of this invention is to provide a display-storage case that provides a sportscard dealer or collector with a single unit that is both portable and light weight and with the potential of storage and/or display of sportscards without having to transfer cards from one unit to the other and this is done by using norelco of similar single cassette box lids, glued together in such a fashion which would allow hard plastic sportscard holders to be deposited in each of the lids cavities at a forty five degree angle with the lids being placed piggy back fashion with one or more lids forming a tray that is placed into a display case in such a manner that the transparent cover of the display case, when closed, will slightly touch the tips of the sportscard holders eliminating movement of the sportscard holders and allowing for the display case to be carried like a brief case without possible movement of the cards in their holders and also allowing for storage of cards and immediate display of cards without touching the hard plastic sportscard holders.

DESCRIPTION OF RELATED ART

There are no available showcases or display cases that are designed solely for the display and/or storage of sportscards.

The cases used for display of sport cards are the same cases that antique and flea market dealers use to display their wares and are not adventageous to a baseball card dealer or collector. The present cases presently used are very heavy and cumbersome and are not easily adaptable for transporting and display of sportscards.

The principal object of this invention is to eliminate most of the cumbersome and tiresome work required when setting up a sportscard display and a safe mode of transporting and displaying the sportscards with the least amount of effort and possibility of damage to the cards. The object is also to make it possible for a sportscard dealer to set up his entire display in one tenth of the time required now and also allow the dealer the privilege of not having to handle his sportscards, only to fill the case and to sell one of the cards. This invention also eliminates the need for some of the seperate storage cases needed to store cards for transporting to various venues.

With the showcase and the card tray portion of this invention being only approximately two inches thick, two of these inventions can be stored in the space usually required for one of the only other available showcases or display cases.

DETAILED DESCRIPTION OF DRAWINGS

Figure 1:
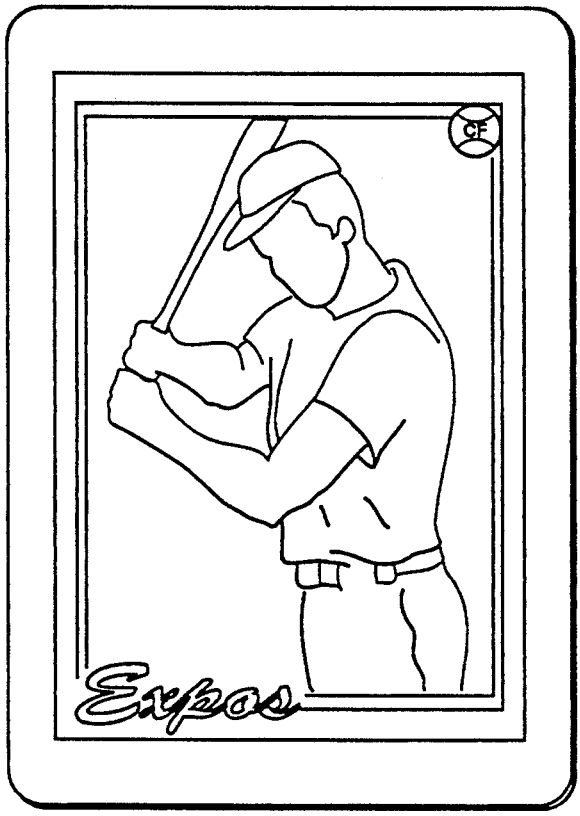
FIG. 1 shows $2\frac{1}{2}'' \times 3\frac{1}{2}''$ sportscard in a $3'' \times 4''$ hard plastic holder common to the sportscard trade.

FIG. 1 —A $2\frac{1}{2}'' \times 3\frac{1}{2}''$ sportscard in a $3'' \times 4''$ hard plastic holder that is common to the trade.

Figure 2:
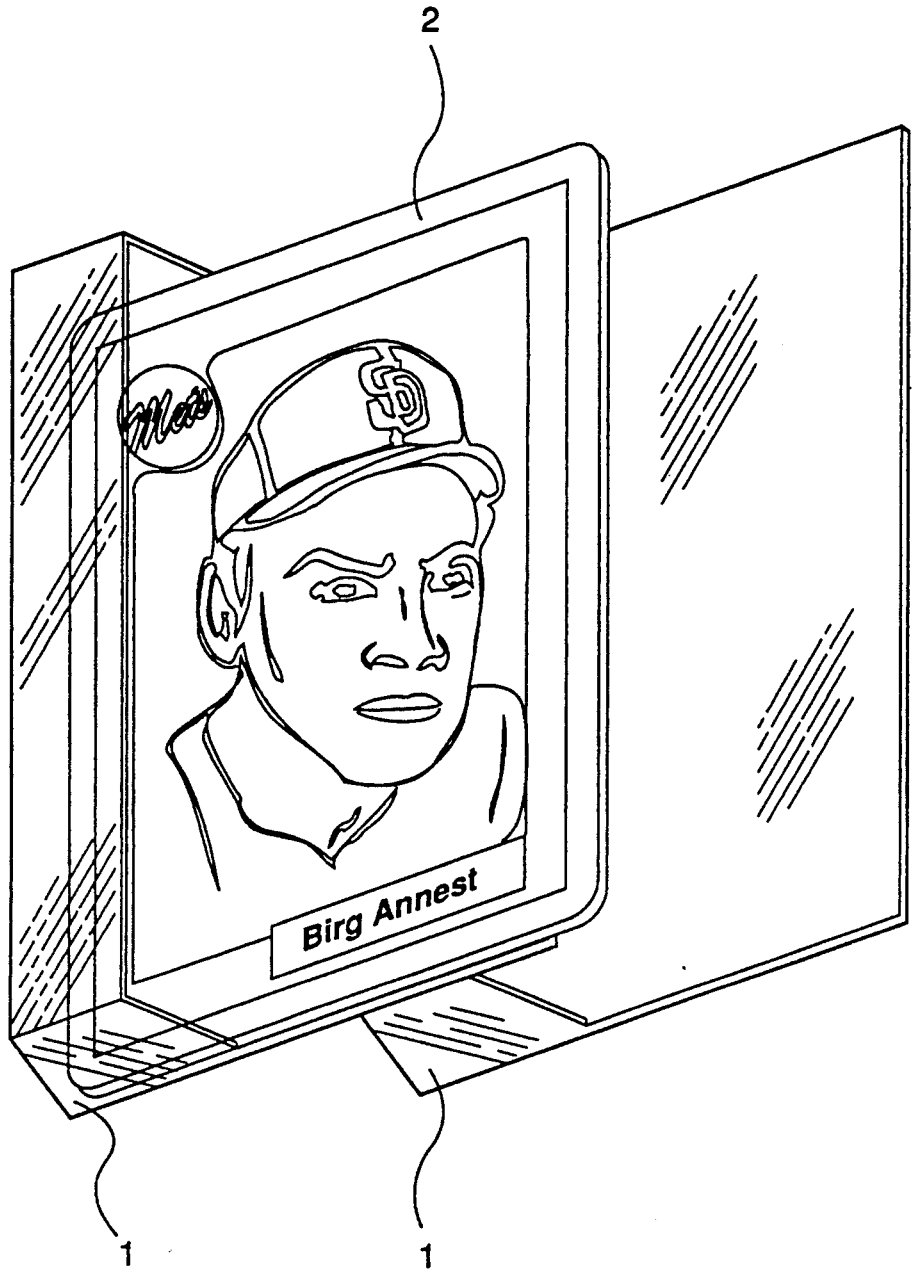
FIG. 2 shows two sportscard holder trays with a sportscard in a hard plastic holder lying in one of the trays or cavities.

FIG. 2 —Two of the inventions sportscard holder trays (1) as they would appear when fastened together with a sportscard in a hard plastic holder (2) lying as it would appear in one of the trays or cavities.

Figure 3:
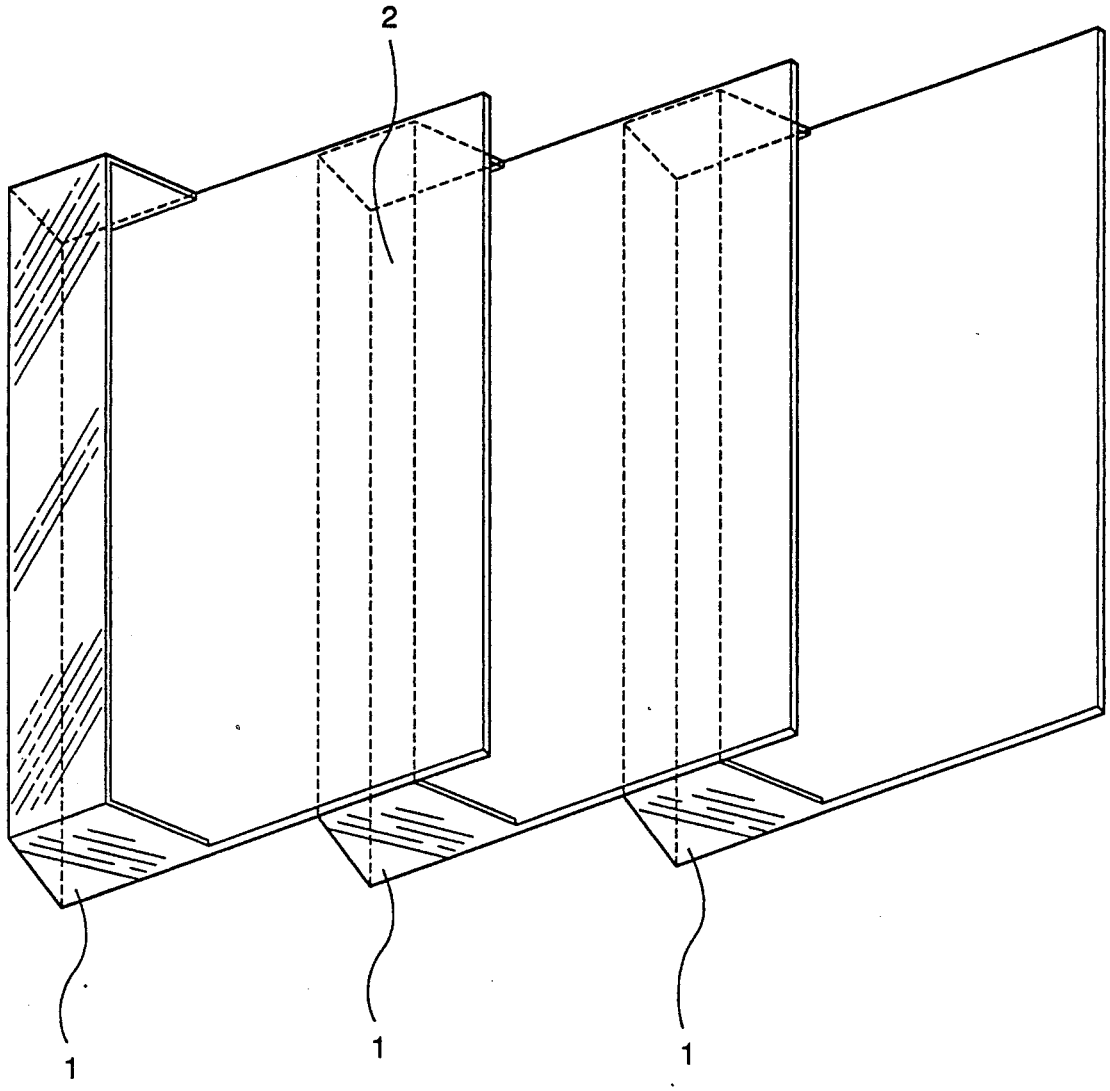
FIG. 3 shows three of the invention trays glued together.

FIG. 3—The lid portion (1) of 3 norelco single cassette 2 3/16"×4 3/16"boxes or comparable single cassette box lids as they would appear having been fastened together by glue (2) or by other means common to the trade.

Figure 4:
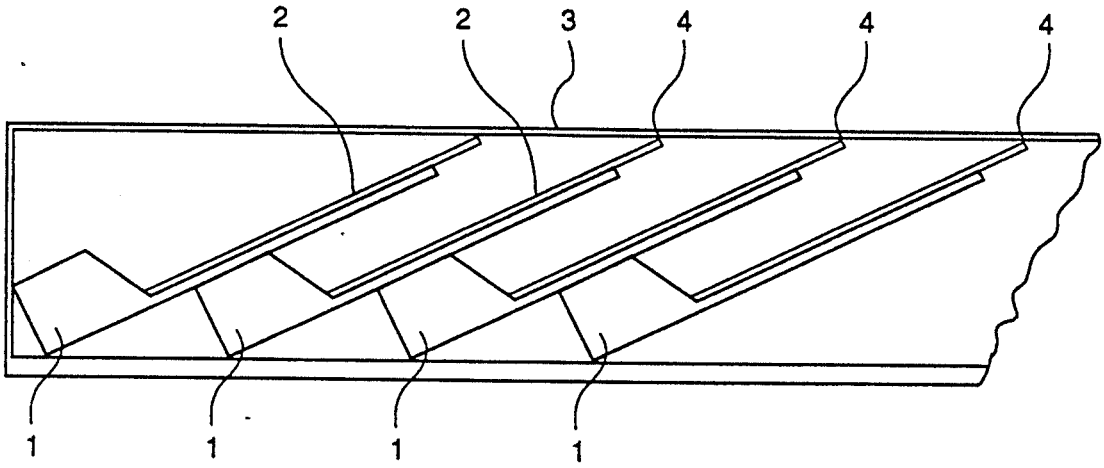
FIG. 4 shows side view of showcase with trays in position.

FIG. 4 —A side view of the invention with several of the norelco single cassette box lids as they would appear after being glued together at a forty five degree angle and with hard plastic sportscard holders (2) fitting comfortably in each individual tray or cavity or cassette box lid cavity, and with the transparent cover of the display case in a closed position, the plexi-glas (3) or comparable transparent material cover rests slightly against the hard plastic sportscard holders (4) keeping the holders from moving during transporting and the transparent cover also allowing for display of sportscards without handling of the hard plastic holders.

Figure 5:
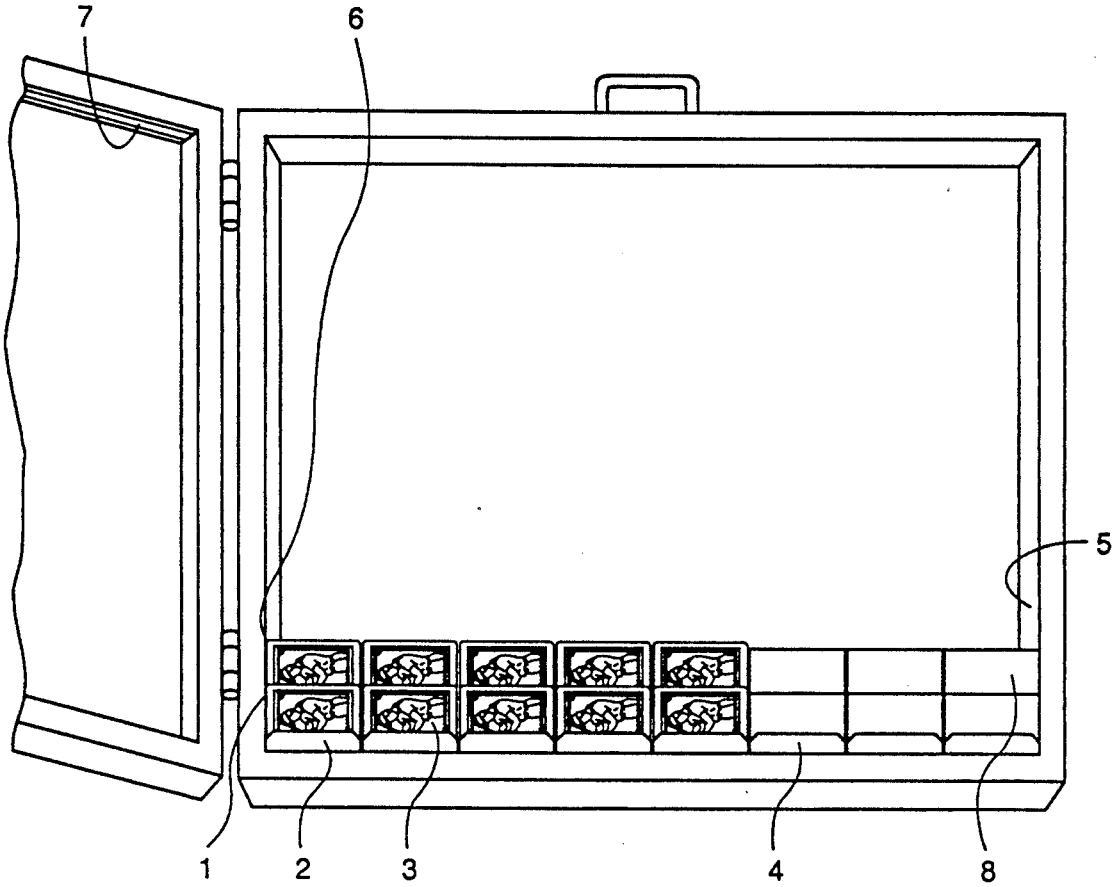
FIG. 5 shows display case with sportscard trays installed.

FIG. 5 —Display case with sportscard trays (4) (2) and sportscards hard plastic holders (3) as they appear in invention with each tray measuring 1" in heighth at the tip (8) of tray and each hard plastic sportscard holder measuring $1\frac{1}{4}''$ in heighth from bottom of display case with display case measuring 1" height from bottom to top of side of bottom portion (5) of display case and transparent or plexi-glas cover measuring $1\frac{1}{4}''$ (7) from bottom of bottom portion of display case to transparent or plexi-glas cover when cover is closed therefore, as the tips of the hard plastic sportscard holders (1) (6) rise $\frac{1}{4}''$ above the sides of bottom portion of display case, the plexi-glas cover will slightly touch the hard plastic holders tips when the cover is in a closed position.

I claim:

1. A tray comprising a plurality of cassette box lids, means for fastening the lids together so that each lid in a longitudinal row is placed upside down and overlaps an adjacent lid at an approximately forty five degree angle to form a plurality of pockets.

2. The tray of claim 1 including a holder for a sportscard sized to fit each said pocket to form a display for sportscards.

3. The tray of claim 2, wherein the holder is a hard plastic frame.

4. The tray of claim 1 in combination with a display case, said case having a transparent top and sized to recieve said tray.

5. The tray of claim 2 in combination with a display case adapted to receive said tray, said case having a transparent lid constructed to touch and prevent the movement of each holder upon being closed.

* * * * *